US009789994B2

(12) United States Patent
Takeuchi

(10) Patent No.: US 9,789,994 B2
(45) Date of Patent: Oct. 17, 2017

(54) PACKING BOX

(71) Applicant: KYOCERA Document Solutions Inc., Osaka-shi, Osaka (JP)

(72) Inventor: Masakazu Takeuchi, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 33 days.

(21) Appl. No.: 15/001,264

(22) Filed: Jan. 20, 2016

(65) Prior Publication Data

US 2016/0214760 A1 Jul. 28, 2016

(30) Foreign Application Priority Data

Jan. 28, 2015 (JP) ..... 2015-014505

(51) Int. Cl.

| | |
|---|---|
| ***B65D 5/10*** | (2006.01) |
| ***B65D 5/42*** | (2006.01) |
| ***B65D 5/36*** | (2006.01) |
| ***B65D 5/02*** | (2006.01) |
| ***B65D 5/50*** | (2006.01) |
| ***B65D 5/54*** | (2006.01) |

(52) U.S. Cl.

CPC ..... *B65D 5/3621* (2013.01); *B65D 5/0254* (2013.01); *B65D 5/10* (2013.01); *B65D 5/4266* (2013.01); *B65D 5/5014* (2013.01); *B65D 5/5415* (2013.01)

(58) Field of Classification Search

USPC .... 229/102, 125.19, 125.28, 125.27, 125.32, 229/143, 142, 151–158

See application file for complete search history.

(56) References Cited

U.S. PATENT DOCUMENTS 2,116,652 A * 5/1938 Leon Adler ..... B65D 5/10 206/232
4,088,262 A * 5/1978 Kuehlhorn ..... B65D 5/4608 206/194

(Continued)

FOREIGN PATENT DOCUMENTS

JP 2003128053 A 5/2003
JP 2004051202 A 2/2004

(Continued)

OTHER PUBLICATIONS

Office Action issued in the counterpart Japanese Patent Application No. 2015-014505, dated Sep. 20, 2016.

*Primary Examiner* — Christopher Demeree
*Assistant Examiner* — Phillip Schmidt

(57) ABSTRACT

The packing box includes a plurality of side wall parts, a bottom wall part, a housing part, an outer lid part, a tuck, an extending part, an inner flap, a slit, and an obstructive part. The obstructive part is folded along the side edge that crosses the other side wall part of the inner flap. Once the tuck is inserted, the extending part restricts the release of the outer lid part by being restored to the original state in the direction that crosses the extending direction of the slit. The obstructive part is placed in the course that reaches from the clearance between the top edge of the side wall part, the top edge crossing the other side wall part, and the inner flap to the extending part, whereby obstructing the approach from the outside of the packing box to the extending part.

5 Claims, 8 Drawing Sheets

(56) References Cited

U.S. PATENT DOCUMENTS

| | | | | | |
|---|---|---|---|---|---|
| 4,535,929 | A * | 8/1985 | Sherman, II | B65D 5/103 | 206/459.5 |
| 4,830,270 | A * | 5/1989 | Holmes | B65D 5/0254 | 206/807 |
| 8,408,451 | B2 * | 4/2013 | Adam | B65D 5/6608 | 229/102 |
| 2016/0214758 | A1 * | 7/2016 | Yamamura | B65D 5/6608 | |

FOREIGN PATENT DOCUMENTS

| | | | | | |
|---|---|---|---|---|---|
| JP | 2007050920 | A | | 3/2007 | |
| JP | 2008094434 | A | | 4/2008 | |
| JP | 2009137598 | A | | 6/2009 | |
| JP | 2013177152 | A | | 9/2013 | |
| WO | WO 2013/007306 | | * | 1/2013 | B65D 5/0254 |
| WO | WO 2015/140704 | | * | 9/2015 | B65D 5/0254 |

* cited by examiner

PACKING BOX

INCORPORATION BY REFERENCE

The disclosure of Japanese application No. 2015-014505 filed on Jan. 28, 2015 including the specification, drawings, and abstract is incorporated herein by reference in its entirety.

BACKGROUND

This disclosure relates to a packing box.

At the time of conveyance of the precision devices and apparatuses such as an image forming device represented by a digital multifunction peripheral, or an information appliance, the devices and apparatuses are packed for the purpose of preventing breakage of or damage to the device and apparatuses during conveyance. To pack the device, packing boxes made of corrugated fiberboard or the like material may be used.

Some techniques about the packing of devices and apparatuses have been already disclosed.

As an example, a knockdown packing box that is made of corrugated fiberboard and is in a hexahedron shape having four side faces that is consecutively provided to surround the bottom face is disclosed. In a fabricated state, this packing box has appropriate boundaries and an opening to observe articles (contents) in the box on the bottom surface.

As another example, a cushion material for packing is disclosed. This cushion material for packing is formed of a cushion material and is used to maintain the clearance between either the undersurface or the four side surfaces of packed articles and the inner surface of the packing box. This cushion material comprises a corrugated fiberboard sheet, and the both sides of the material are provided with rectangular sleeves the section of which is in an approximately rectangular shape. Furthermore, a U-shaped sleeve having an approximately U-shaped section is disposed such that it is perpendicular to the rectangular sleeves. This U-shaped sleeve can lock the upper parts of the both ends of the rectangular sleeves at the upper parts of the both ends of the U-shaped sleeve.

As still another example, the packing box which is consecutively provided with a bottom plate, side plates and a top plate, to form a wide tube, is disclosed. A plurality of mountain fold lines are formed from one end to another end of the bottom plate such that the plurality of mountain fold lines are arranged in parallel. Similarly, a plurality of valley fold lines are formed from one end to another end of the top plate such that the plurality of mountain fold lines are arranged in parallel. This bottom plate is to be folded along the mountain fold lines such that the lower surface of the bottom plate should be protruded. Then, the top plate is to be folded along the valley fold lines such that the upper surface of the top plate should be recessed. In a stacked state, the top surface of the lower box is fitted into the bottom surface of the upper box. End plates are extended from each of the bottom plate, the side plates and the top plate and these end plates are engaged with each other, to close the edge face of the wide tube. The shape of the wide tube is thus maintained. Then, the projecting part is provided on the end plate that extends from the side plate. This end plate that extends from the side plate and the end plate that extends from the top plate are meshed with each other via the projecting part, and then the end plate that extends from the bottom plate is engaged therewith. Then, the outer vertical plate provided consecutively on one end of the bottom plate is raised, and the lower part of the side vertical plate provided consecutively on either side of outer vertical plate is superposed on the outer surface of the side plate. The inner vertical plate provided consecutively with the side vertical plates is arranged in an opposite position to the outer vertical plate, to form a vertical tube. Furthermore, the pillar piece of the side plates is wrapped with the vertical tube, and lock pieces that are provided on the lower part of the side vertical plates are inserted into lock holes that are provided at the lower part of the side plates.

As yet another example, a corrugated fiberboard packing box with an automatically-lockable bottom is disclosed. This packing box includes a multi-layer corrugated fiberboard sleeve that is freely changeable between a square cylindrical fabricated form and a flat folded form. The bottom of the box is closed by an automatically-lockable bottom wall. The sleeve has four side wall parts provided consecutively in parallel via vertical lines. The side wall parts consists of multi-layered corrugated fiberboards which have three or more layers. In the fabricated form, the box is formed so as to be folded into a flat form along a pair of vertical ruled lines which are located diagonally. Each of the side wall parts of the sleeve has a lower ledge, and the automatically-lockable bottom wall is formed by bottom wall constitution plates which are attached to the lower ledge of the side wall parts. When the sleeve is folded into a flat form, each of the bottom wall constitution plates is also folded, and when the sleeve is fabricated in a square cylindrical shape, each of the bottom wall constitution plates spreads to close the bottom of the sleeve.

As yet another example, the packing box for automobile bumpers is disclosed. This packing box consists of an inner box part which is intended to wrap the middle portion of a bumper and a pair of side box portions which is intended to wrap the both sides of the bumper, a base, opposed edge plates, and a lid plate. In this packing box, edge plates are bent according to the angle between an intermediate portion and the both side parts of the bumper over the portion from the inner box part to a pair of side box parts. In the inner box part, edge plates are coupled to the base directly. In the side box part, the base is formed in a tapered shape according to the shapes of the both side parts of the bumper. A folding piece is placed between the base and the edge plates, and the base and the edge plates are folded along the ruled line of the boundary between the inner box part and the side box part. Then, the inserting piece is interfolded along the central valley fold line.

SUMMARY

According to one aspect of this disclosure, the packing box includes a plurality of side walls, a bottom wall part, a housing part, an outer lid part, a tuck, an extending part, an inner flap, a slit, and an obstructive part. The plurality of side walls compose peripheral walls. The housing part is composed of the plurality of side walls and the bottom wall part, and houses an article to be packed. The outer lid part is provided consecutively with one side wall part of the plurality of side wall parts and opens and closes the upper part of the housing part towards the opposed other side wall part. The tuck extends from the tip edge of the outer lid part, and is to be folded along the tip edge. The extending part crosses the tip edge of the tuck and extends from the side edge. The inner flaps are provided consecutively with other side wall part and are to be folded inward. The inner flap is provided with the slit, which is cut along the other side wall part. The obstructive part is configured to be folded along a folding part crossing the other side wall part. The tuck is configured to be inserted into the slit while the extending part is folded. Once the tuck is inserted, the extending part restricts the release of the outer lid part by being restored to the original state in the direction crossing the extending direction of the slit. The obstructive part is configured to be placed in the course that reaches from the clearance between the top edge of the side wall part which crosses the other side wall part, and the inner flap to the extending part, whereby obstructing the approach from the outside of the packing box to the extending part.

DETAILED DESCRIPTION

Figure 1:
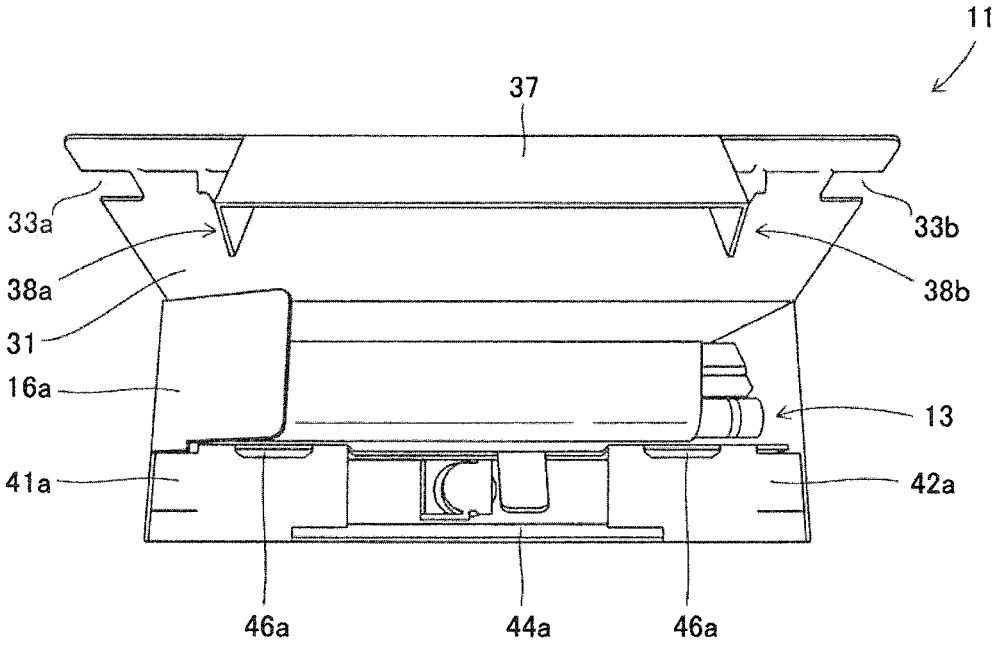
FIG. 1 shows a schematic perspective view of the packing box according to one embodiment of this disclosure.
Figure 2:
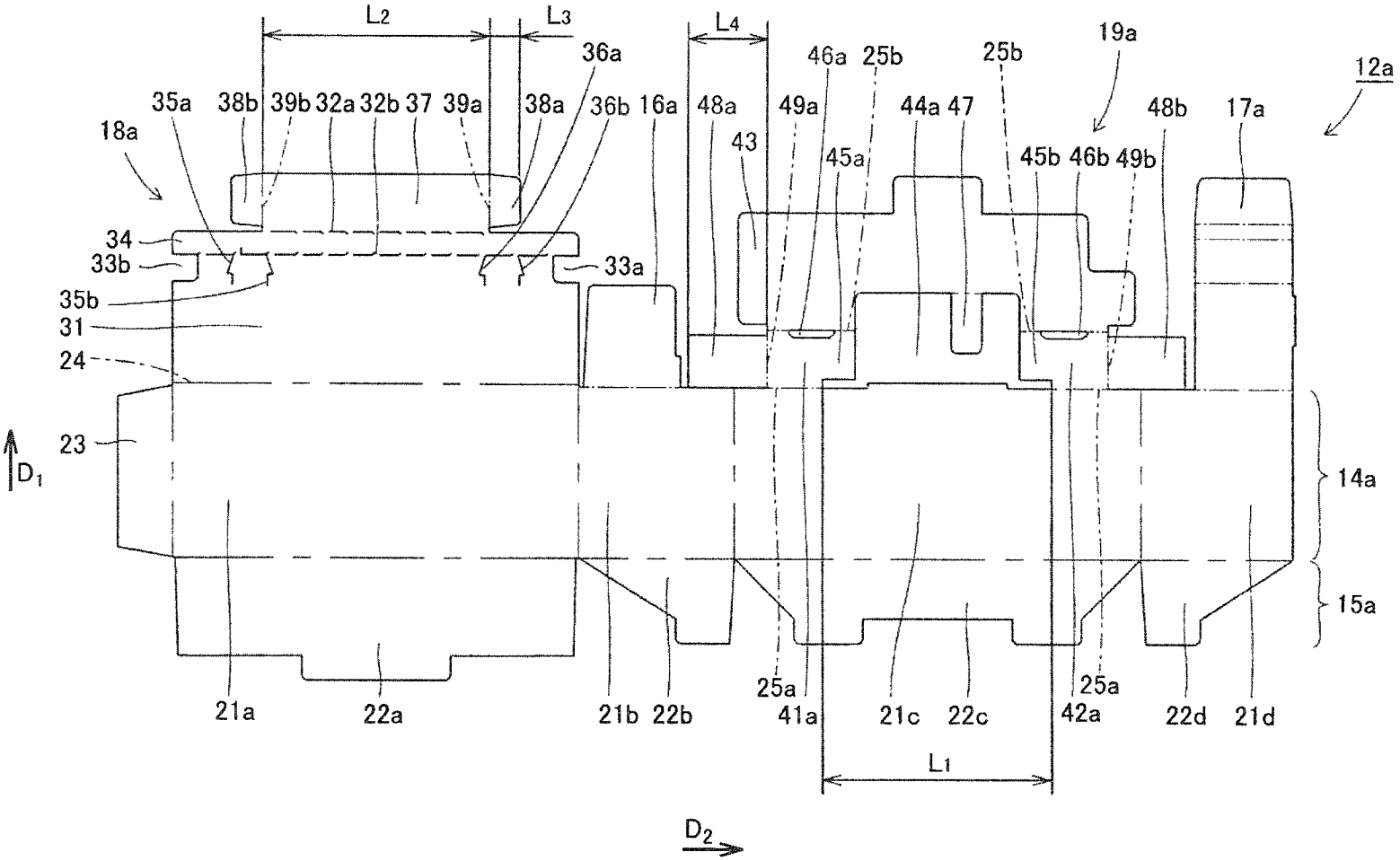
FIG. 2 shows a development view illustrating a corrugated fiberboard member before fabrication of the packing box according to one embodiment of this disclosure.
Figure 3:
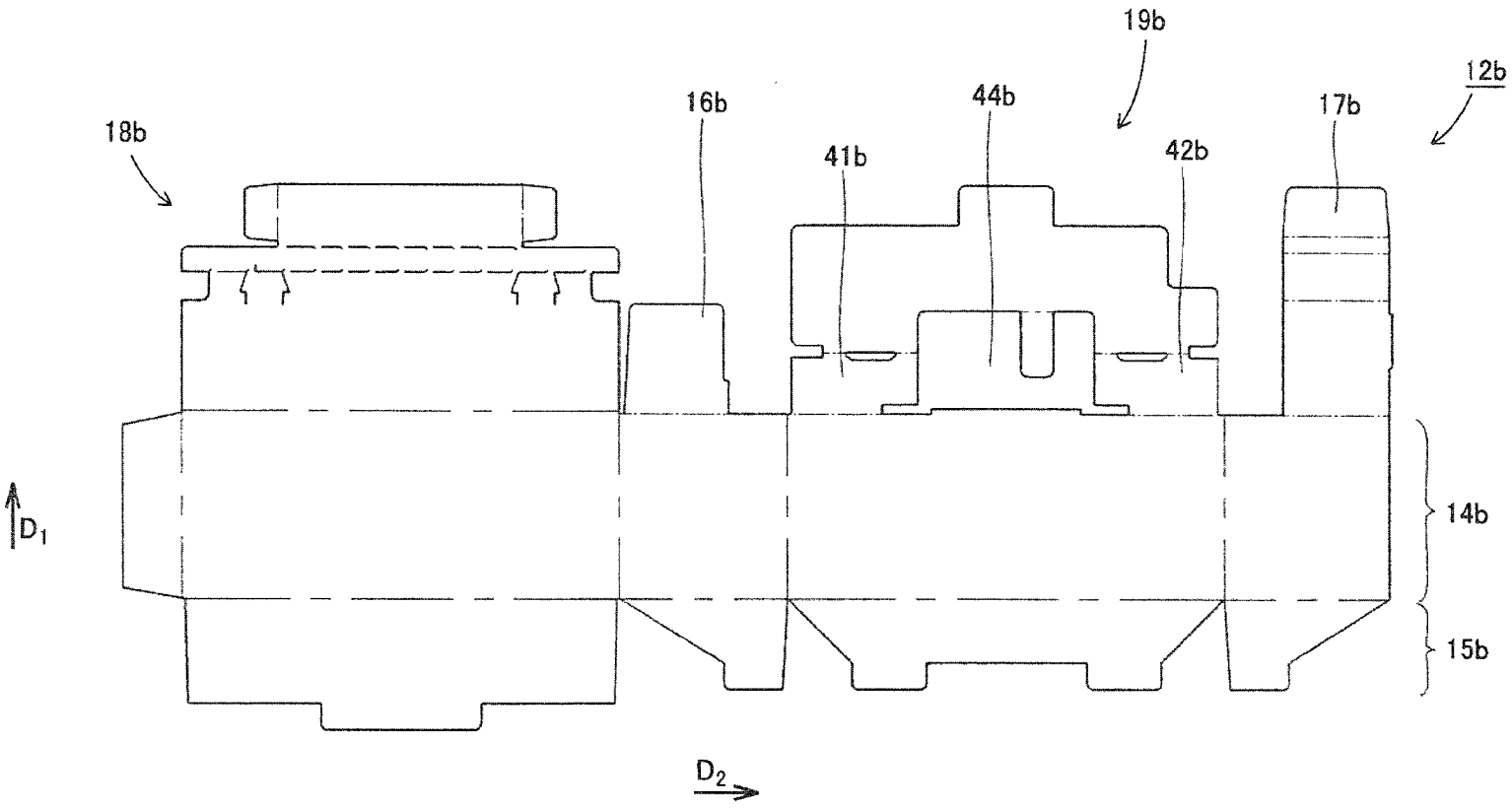
FIG. 3 shows a development view illustrating a state where the corrugated fiberboard member as illustrated in FIG. 2 does not have the projecting part, which is described below.

Hereinafter, the embodiments of the present disclosure are described. FIG. 1 shows a schematic perspective view of the packing box according to one embodiment of this disclosure. FIG. 2 shows a development view illustrating a corrugated fiberboard member before fabrication of the packing box according to one embodiment of this disclosure. FIG. 3 shows a development view illustrating a state where the corrugated fiberboard member as illustrated in FIG. 2 does not have the projecting part, which is described below. From the viewpoint of easiness of understanding, the direction as illustrated in the arrow $D_1$ in FIGS. 2 and 3 is assumed a vertical direction which directs from the bottom to the top. Also, the direction as illustrated in the arrow $D_2$ in FIGS. 2 and 3 is assumed a direction toward the right from the left.

Referring to FIGS. 1 to 3, the packing box 11 according to one embodiment of this disclosure is a so-called generally rectangular parallelepiped shape. The packing box 11 is formed of a single sheet of a plate-like member that has force of restitution when it is folded. Specifically, the packing box 11 is formed by fabricating a corrugated fiberboard member 12*a*.

As recognized from the development view as illustrated in FIG. 2, the packing box 11 is formed by, for example, preparing a sheet of rectangular corrugated fiberboard member, then punches out the corrugated fiberboard member into a form as illustrated in FIG. 1, and finally sequentially folding the corrugated fiberboard member at the folding parts as illustrated in the dashed line. The packing box 11 houses an articles to be packed, such as a developer unit, a toner cartridge, or the like, which are consumables in the image forming device. FIG. 1 shows a toner cartridge 13 as an article to be packed, which is wrapped with a plastic bag.

The packing box 11 includes side wall parts 14*a* which are to be located, when the toner cartridge 13 is housed inward, in the lateral side, a bottom wall part 15*a* which is to be located in the lower side of the toner cartridge 13, a pair of inner flaps 16*a* and 17*a* which are to be mainly located in the upper side of the toner cartridge 13, and the outer lid parts 31 which is similarly to be mainly located in the upper side of the toner cartridge 13. The packing box 11 is formed of the side wall parts 14*a* and the bottom wall part 15*a*, and has a housing part 20 to house an article to be packed.

The corrugated fiberboard member 12*a*, which is to be folded to form the packing box 11, includes four sidewall forming parts 21*a*, 21*b*, 21*c*, and 21*d*, which constitute the side wall parts 14*a*, four bottom wall forming parts 22*a*, 22*b*, 22*c*, and 22*d*, which constitute the bottom wall part 15*a*, inner flaps 16*a*, 17*a*, and 19*a*, the outer lid parts 31, and partition part 43 which restricts the movement of the packed article in the packing box 11.

The packing box 11 formed of such a corrugated fiberboard member 12*a* includes side wall parts 14*a* and the bottom wall part 15*a* and the outer lid part 31. Also, the packing box 11 houses a toner cartridge 13 in the space surrounded by the side walls 14*a* and the bottom wall part 15*a*, and closes the above side of the toner cartridge 13 by the outer lid part 31 to pack the toner cartridge 13. The outer lid part 31 is provided consecutively with one side wall part 14*a* of side wall parts 14*a* and opens and closes the upper part of housing part 20 towards the opposed other side wall 14*a*. The inner flaps 16*a*, 17*a*, and 19*a* are provided consecutively with the other side wall parts and are to be folded inward.

The four bottom wall forming parts 22*a*, 22*b*, 22*c*, and 22*d* are provided consecutively from the lower end of the four sidewall forming parts 21*a*, 21*b*, 21*c*, and 21*d*, respectively. The outer lid part 31 is provided consecutively from the upper end of the sidewall forming part (one side wall part) 21*a*. The outer lid part 31 is located outermost at the top position after the packing box 11 is fabricated. The inner lid parts 41*a* and 42*a* are provided consecutively from the upper end of the sidewall forming part (other side wall part) 21*c*. After the packing box 11 is fabricated, the inner lid parts 41*a* and 42*a* are placed inside the outer lid part 31, namely, on the side of the space in which the cartridge 13 is to be housed.

A pair of inner flaps 16*a* and 17*a* are provided consecutively from the upper end of the sidewall forming parts 21*b* and 21*d*, respectively. The pair of the inner flaps 16*a* and 17*a* are also located inside the outer lid part 31 after packing box 11 is fabricated. The length of the inner flap 17*a* from the upper end of the sidewall forming part 21*d* is larger than the length of the flap 16*a* from the upper end of the sidewall forming part 21*b*. The inner flap 17*a* is configured to be folded at a plurality of points. After the toner cartridge 13 is housed in the packing box, the inner flap 17*a* is folded appropriately along the peripheral shape of the toner cartridge 13.

The four sidewall forming parts 21*a* to 21*d* are in a flat plate form, respectively, and are provided consecutively in the horizontal direction. Folding parts illustrated by dashed lines are located at each boundary of the four sidewall forming parts 21*a* to 21*d*. The sidewall forming parts 21*a* and 21*c* each have a rectangular shape which is longer in a horizontal direction. The sidewall forming parts 21*b* and 21*d* each have a rectangular shape which is slightly longer in a vertical direction. The vertical length of the four sidewall forming parts 21*a* to 21*d* are the same as one another. Each horizontal length of the sidewall forming parts 21*b* and 21*d* is approximately one-third of that of the sidewall forming parts 21*a* and 21*c*.

The sidewall forming parts 21*a* to 21*d* are to be folded at the folding parts located therebetween such that the periphery of the sidewall forming parts should form a rectangular shape when it is viewed from the vertical direction. Namely, the sidewall forming parts 21*a* to 21*d* is folded by approximately 90° to adjacent one of the sidewall forming parts 21*a* to 21*d*, respectively. Then, the sidewall forming parts 21*a* to 21*d* are formed into a square cylindrical shape by attaching a glue flap 23, which are provided consecutively on the left side of the sidewall forming part 21*a*, to the sidewall forming part 21*d* with an adhesive or the like. The side wall parts 14*a* are formed in this way.

The bottom wall part 15*a* is formed by interlocking the four bottom wall forming parts 22*a*, 22*b*, 22*c*, and 22*d* when sidewall forming parts 21*a* to 21*d* are folded into a rectangular shape. The bottom plate part 15*a* becomes the part which the toner cartridge 13 is to be put on. The four bottom wall forming parts 22*a* to 22*d* have projected and depressed portions which engage with each other. The four sidewall forming parts 21*a* to 21*d* are interlocked such that depression of the depressed portion and projection of the projected portion which are provided on the bottom wall forming parts 22*a* to 22*d* are engaged with one another when the four sidewall forming parts 21*a* to 21*d* are folded along the folding parts as illustrated in the dashed line.

A pair of the inner flaps 16*a* and 17*a* are folded inward after the sidewall forming parts 21*a* to 21*d* are folded into a rectangular shape, and before or after housing the toner cartridge 13. In this case, one inner flap 17*a* is interfolded to hold the edge of the toner cartridge 13, and the other inner flap 16*a* is folded after housing the toner cartridge 13.

The outer lid part 31 is to be folded along the folding part 24, which forms the boundary between the outer lid part 31 and the sidewall forming part 22*a*, to form the outer lid of the packing box 11. The outer lid part 31 is provided with a pair of perforations 32*a* and 32*b*, which extend horizontally. Notches 33*a* and 33*b* are provided around the horizontal ends of the perforations 32*a* and 32*b*. These notches 33*a* and 33*b* makes it easy to take out the packing box 11 from a certain place by sticking fingers in the notches 33*a* and 33*b*. By pulling and breaking a part 34 of the outer lid part 31 along the perforations 32*a* and 32*b*, the outer lid part 31 can be opened without releasing the locking device which is described below. Further, perforations 35*a*, 35*b*, 36*a*, and 36*b* are provided near the each horizontal end of the perforation 32*b*. By breaking a part of the outer lid part 31 along the perforations 35*a*, 35*b*, 36*a*, and 36*b*, a through hole which penetrates the outer lid part 31 in the thickness direction can be provided at a part of the outer lid part 31.

The upper edge of the outer lid part 31 is provided with a tuck 37, which extends upward, namely in the direction as illustrated by the arrow $D_1$. This tuck 37 is provided such that it extends consecutively from the outer lid 31, more specifically, such that it extends upward continuously from the position provided with the upward perforation 32*a*. The tuck 37 has a horizontally long rectangular shape. The tuck 37 can be folded along the perforation 32*a*. Namely, the tuck 37 extends from the edge of the top of the outer lid part 31, and is configured to be foldable. The tuck 37 is used when the outer lid part 31 is closed to the side of the side wall part 14*a*.

On the outer lid part 31, a pair of extending parts 38*a* and 38*b* are provided. The extending parts 38*a* and 38*b* extend in a horizontal direction of the tuck 37, namely, one extends in the direction shown by the arrow $D_2$ and the other extends in the reverse direction thereof. A pair of the extending parts 38*a* and 38*b* are each provided to extend in a horizontal direction. Namely, a pair of the extending parts 38*a* and 38*b* each cross the tip edge of the tuck 37 and extend from the side edge. The pair of extending parts 38*a* and 38*b* can be folded along the folding parts 39*a* and 39*b*, respectively. Namely, the pair of extending parts 38*a* and 38*b* are each configured to be foldable to the tuck 37. The vertical length of each of the pair of the extending parts 38*a* and 38*b* is configured such that it is slightly shorter than the vertical length of the tuck 37.

Similarly to the above pair of the inner flaps 16*a* and 17*a*, the inner flap 19*a* is to be folded after the sidewall forming parts 21*a* to 21*d* are folded into a rectangular shape, and before or after housing the toner cartridge 13. The inner flap 19*a* is to be folded at the folding part 25*a*, to form the inner lids 41*a* and 41*b*. Namely, on the side of the side wall parts 14*a* of the inner flap 19*a*, the inner lids 41*a* and 41*b*, which are consecutively provided and are to be placed inside the outer lid part 31, is provided. Furthermore, the inner flap 19*a* is to be folded at the folding part 25*b*, to form a partition part 43, which spreads vertically to divide the inner space in the packing box 11. The partition part 43 restricts the movement of the toner cartridge 13 that is housed in the packing box 11.

The inner flap 19*a* is provided with a slit 44*a* through which the tuck 37 and a pair of the extending parts 38*a* and 38*b* can be inserted. The horizontal width $L_1$ of the slit 44*a* is slightly wider than the horizontal width $L_2$ of the tuck 37. Here, the slit 44*a* has a shape that is cut along the shape of another side wall part 14*a*. The inner lid parts 41*a* and 42*a* are divided horizontally by the slit 44*a*. The inner lid parts 41*a* and 42*a* are provided with jutting parts 45*a* and 45*b* which juts out to the side of the slit 44*a*. The jutting parts 45*a* and 45*b* forms an interfere part that interferes with a pair of the extending parts 38*a* and 38*b* that returns to the original shape to some extent after they are inserted into the slit 44*a*. Namely, the packing box 11 comprises an interference part that is to be folded from the side edge, which crosses the side wall part 14*a* of the inner flap 19*a*.

Another rectangular jutting parts 47 projecting into the side of the slit 44*a* is provided also on the side of the partition part 43 side. This jutting part 47 is to be folded and is also used to restrict the movement of housed toner cartridge.

Here, the inner lid part 41*a* is provided with a projecting part 48*a* which projects outward from the left side end in the FIG. 2, namely, which projects leftward in the reverse direction as illustrated by the arrow $D_2$. The inner lid part 42*a* is provided with a projecting part 48*b* which projects outward from the right side end in the FIG. 2, namely, which projects rightward in the direction as illustrated by the arrow $D_2$. Namely, the inner lids 41*a* and 42*a* are provided with a pair of projecting parts 48*a* and 48*b* each of which projects outward from the ends of the outer sides.

A pair of the projecting parts 48*a* and 48*b* each have a generally rectangular shape. The projecting length of the projecting part 48*a*, which is illustrated as the length $L_4$ in FIG. 2, is configured to be longer than the extending length of the extending part 38*a*, which is illustrated as the length $L_3$ in FIG. 2. The same shall apply to the relation with the length of the projecting part 48*b* and the length of the extending part 38*b*. A pair of projecting parts 48*a* and 48*b* are folded inward along the folding parts 49*a* and 49*b*, respectively. Namely, the projecting parts 48*a* and 48*b* are configured to be folded relative to the inner lid parts 41*a* and 42*a*, respectively.

Once a pair of projecting parts 48*a* and 48*b* are folded from the side edge that crosses another wall forming part 14*a* of the inner flaps 19*a*, they are located on the course from the outside of the packing box 11 to the pair of the extending parts 38*a* and 38*b* which are inserted into the slit 44*a*. A pair of the projecting parts 48*a* and 48*b* forms an obstructive part to obstruct the contact of other members with a pair of the extending parts 38*a* and 38*b* which are inserted into the slit 44*a*. Namely, the obstructive part includes a pair of the projecting parts 48*a* and 48*b* that extend from the side edge of the inner lids 41*a* and 41*b* to the course as mentioned above.

The development view of the packing box which does not have a pair of the projecting parts 48*a* and 48*b* is shown in FIG. 3. Namely, the corrugated fiberboard member 12*b* includes the side wall parts 14*b* which are to be located in the lateral side when the toner cartridge 13 is housed inward, the bottom wall part 15*b* which is to be located in the lower side of the toner cartridge 13, a pair of the inner flaps 16*b* and 17*b* which are to be mainly located in the upper side the of the toner cartridge 13, and the outer lid part 30 which is similarly to be mainly located in the upper side of the toner cartridge 13. This constitution does not include any pair of projecting parts that projects outward from each of the outer ends of the inner wall parts 41*b* and 42*b* which are divided by the slit 44*b*.

Figure 4:
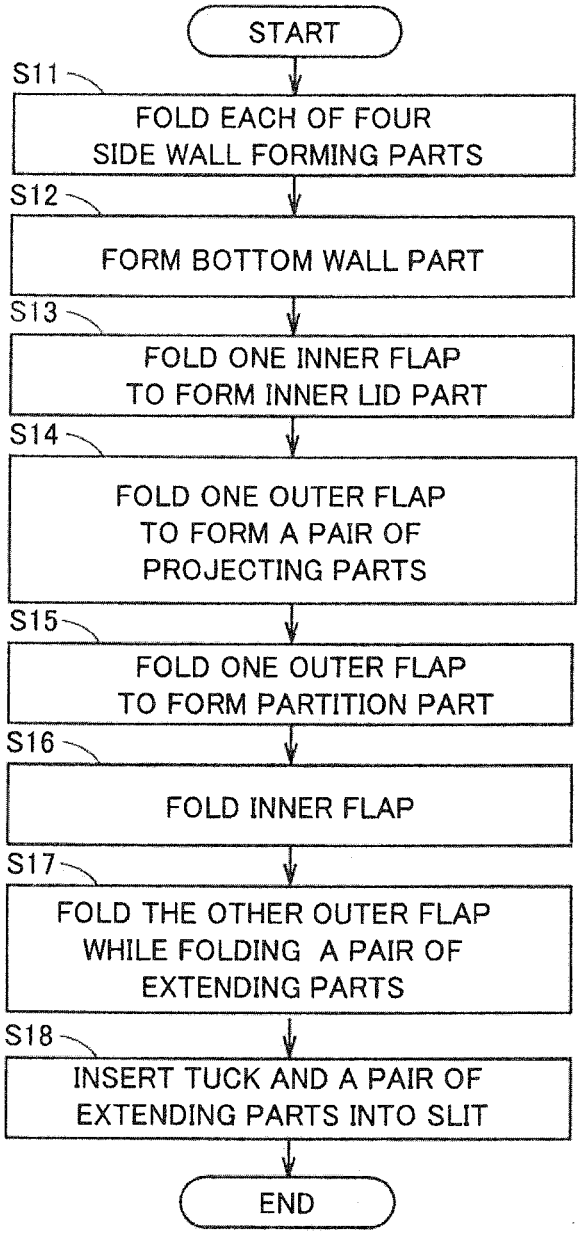
FIG. 4 shows a flow chart illustrating a representative process of fabricating the packing box in which the toner cartridge is housed.

Then, the way to fabricate the packing box 11 from the corrugated fiberboard member 12*a* is described. FIG. 4 shows a flow chart illustrating a representative process of fabricating the packing box 11 in which the toner cartridge 13 is housed.

Referring to FIG. 4, at first, the corrugated fiberboard member 12*a* having the shape as illustrated in FIG. 2 is prepared. Then, the sidewall forming parts 21*a* to 21*d* are folded along the folding parts (corresponding to the step S11 in FIG. 4. Hereinafter, the word "step" is omitted). In this case, the sidewall forming parts 21*a* to 21*d* are folded such that the angle between adjacent two sidewall forming parts 21*a* to 21*d* should be approximately 90°.

However, the corrugated fiberboard member 12*a* is provided in a state where it is folded beforehand and the glue flap 23 and the sidewall forming part 21*d* are attached thereto. In this case, the front surface of the glue flap 23 and the backside surface of the sidewall forming part 21*d*, namely, a surface which is located inward, may be joined with an adhesive. Alternatively, a stapler for corrugated fiberboards may be used to join them.

Then, the depressed portion and the projected portion of the bottom wall forming parts 22*a* to 22*d* are fitted together, to form the bottom wall part 15*a* (S12). In this case, the bottom wall part 15*a* is formed by deforming the bottom wall forming parts 22*a* to 22*d* and the sidewall forming parts 21*a* to 21*d* to some extent and fitting the depressed portion and the projected portion with one another to interlock them together.

Then, one inner flap 19*a* is folded along the folding parts 25*a*, to form the inner lids 41*a* and 42*a* (S13). Here, the outside flap 19*a*, which is provided consecutively with the sidewall forming part 21*c*, is folded inward to form the inner lid parts 41*a* and 42*a*.

Then, one inner flap 19*a* is further folded along the folding parts 49*a* and 49*b* to form a pair of the projecting parts 48*a* and 48*b* (S14). Namely, a pair of the projecting parts 48*a* and 48*b* are formed by folding them along the side edges of the inner lid parts 41*a* and 41*b*. A pair of the projecting parts 48*a* and 48*b* which are formed in a folded state extend from the inner lid parts 41*a* and 42*a* to the lower side.

Then, an inner flap 19*a* is further folded along the folding parts 25*b* to form the partition part 43 (S15). Here, the toner cartridge 13 is housed inside. In this case, the outside flap 19*a* may be folded while the toner cartridge 13 is housed inside. At the same time, one inner flap 17*a* is folded. The steps S14 and S15 may be performed simultaneously, or be performed in any order.

After the toner cartridge 13 is housed, the other inner flap 16*a* is folded inward (S16). At this point in the process, the packing box 11 is in a state where all the folding parts except the outer lid 31 are folded, as illustrated in FIG. 1.

Figure 5:
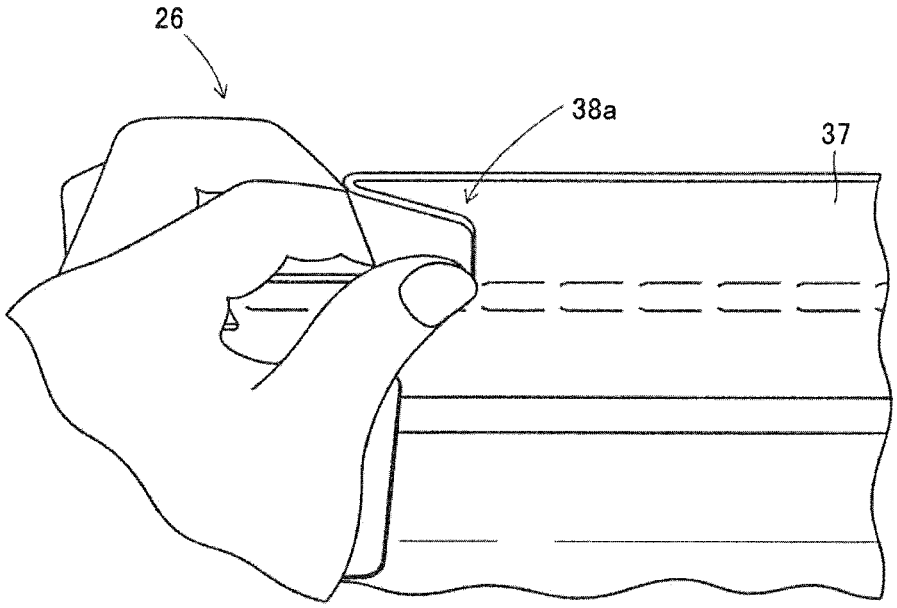
FIG. 5 shows a view illustrating a folded state of an extending part which is folded inwards.

Then, the outer lid part 31 is folded along the folding part 24 while a pair of extending parts 38*a* and 38*b* are folded along the folding parts 39*a* and 39*b* (S17). In this case, the extending part 38*a* is folded back inward with fingers 26 as illustrated in FIG. 5. FIG. 5 shows a view illustrating a folded state of the extending part 38*a* which is folded back inward.

Figure 6:
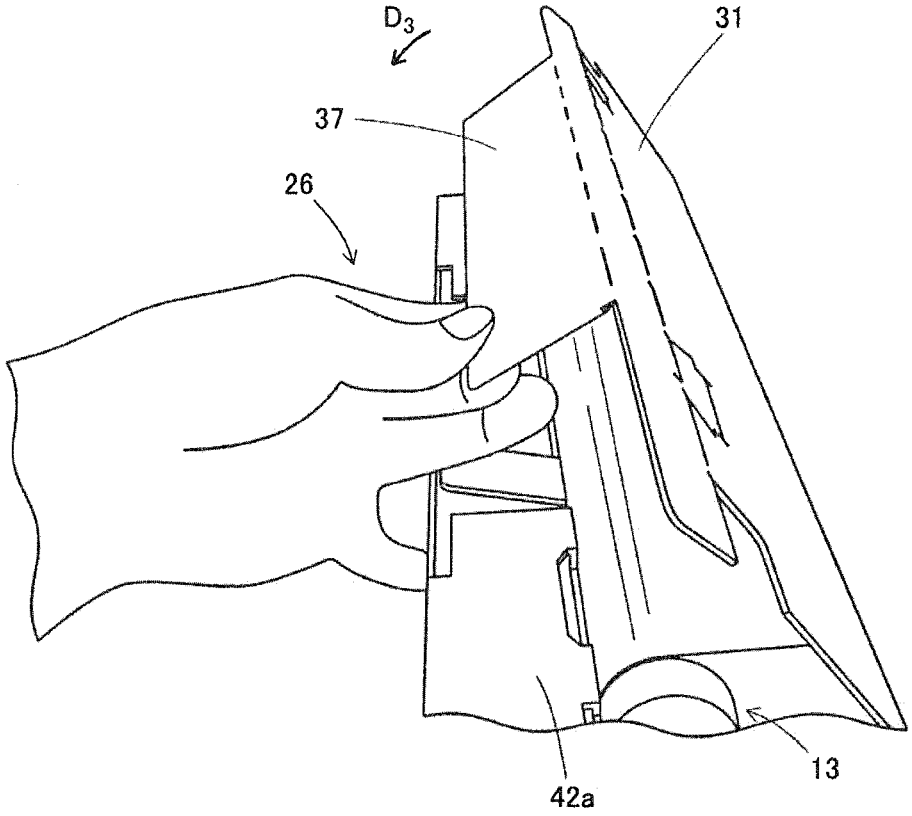
FIG. 6 shows a view indicating a state where the tuck and a pair of extending parts are being inserted into the slit while the state where a pair of extending parts are folded is maintained.

Then, the tuck 37 and a pair of the extending parts 38*a* and 38*b* are inserted in the slit 44*a* while the state where a pair of the extending parts 38*a* and 38*b* are folded is maintained (S18). Namely, the tuck 37 is inserted into the slit 44*a* in the state where a pair of the extending parts 38*a* and 38*b* are folded. In this case, as illustrated in FIG. 6, the state where a pair of the extending parts 38*a* and 38*b* are folded is maintained by holding them with fingers 26, and the outer lid parts 31 is folded in the direction as illustrated by the arrow $D_3$ in FIG. 6. Then, the tuck 37 and a pair of the extending parts 38*a* and 38*b* are inserted into the slit 44*a*. FIG. 6 shows a view indicating a state where the tuck 37 and a pair of extending parts 38*a* and 38*b* are being inserted into the slit 44*a* while the state where the tuck 37 and a pair of the extending parts 38*a* and 38*b* are folded is maintained. In FIG. 6, fingers holding the extending part 38*b* is not illustrated.

Thus, the packing box 11 according to one embodiment of this disclosure is fabricated. After the tuck 37 and a pair of the extending parts 38*a* and 38*b* are folded and then inserted into the slit 44*a*, a pair of the folded extending parts 38*a* and 38*b* restore to the original shape to some extent. Thus, by hooking up a pair of the extending parts 38*a* and 38*b* which restored to the original shape to some extent with the jutting parts 45*a* and 45*b* as the wall parts which constitute the slit 44*a*, the packing box 11 is locked such that the state where the outer lid part 31 is closed relative to the side of the side wall part 14*a* should be maintained. Namely, after the insertion, a pair of the extending parts 38*a* and 38*b* restrict the release of the outer lid part 31 by restoration in the direction crossing the extending direction of the slit 44*a*. A pair of the folded projecting parts 48*a* and 48*b* which are provided on the side of the side wall parts 14*a* are provided on the course from the outside of the packing box 11 to a pair of the extending parts 38*a* and 38*b* which are inserted into the slit 44*a*, and obstruct the contact of the other members with a pair of the extending parts 38*a* and 38*b* which are inserted into the slit 44*a*. Namely, the obstructive part includes a pair of the projecting parts 48*a* and 48*b* which extend from the inner lids 41*a* and 42*b* to the course as described. The obstructive part is placed between the course that reaches from the clearance between the top edge of a pair of the side wall parts 14*a* that cross the other side wall part 14*a* and the inner flap 19 *a* to a pair of the extending parts 38*a* and 39*b*, and obstructs the approach from the outside of packing box 11 to a pair of the extension parts 38*a* and 38*b*.

Figure 7:
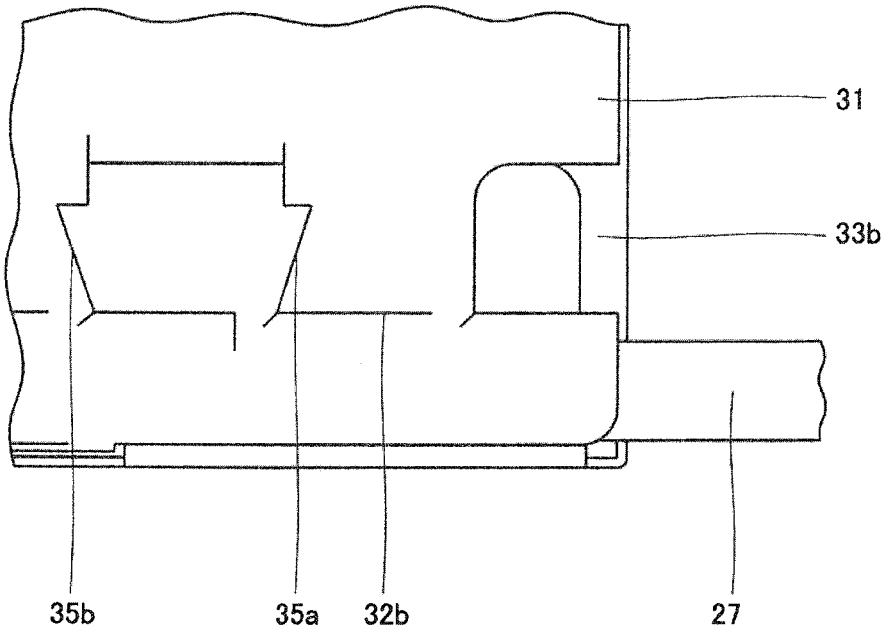
FIG. 7 shows a view illustrating a state where a thin plate member is inserted into the clearance of the fabricated packing box. This figure shows an enlarged view of the front right portion of the packing box in a state where the outer lid part is closed, which is viewed from the top of the packing box.
Figure 8:
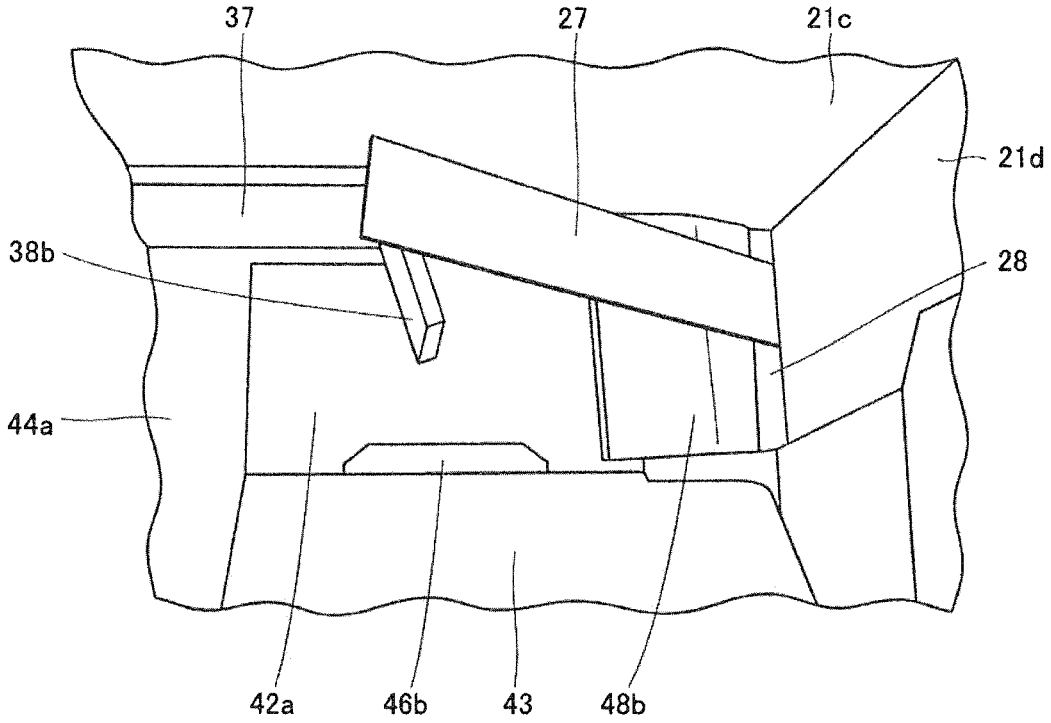
FIG. 8 shows a view illustrating a state where a thin plate member is inserted into the clearance of the fabricated packing box. This figure shows a view of the part illustrated in FIG. 7, which is viewed from the bottom of the inside of the packing box.

More information about this obstructive part is now described. FIGS. 7 and 8 show views illustrating a state where a thin plate member is inserted into the clearance of the fabricated packing box 11. FIG. 7 shows an enlarged view of the upper portion, in this case, the front right portion of the packing box 11 in a state where the outer lid part is closed, which is viewed from the top of the packing box 11. FIG. 7 is a figure which is viewed from the direction which is reverse to the direction as illustrated in the arrow $D_1$ in FIG. 2. FIG. 8 shows a view of the part illustrated in FIG. 7, which is viewed from the bottom of the inside of the packing box 11. FIG. 8 is viewed from the direction as illustrated in the arrow $D_1$ in FIG. 2.

Referring to FIGS. 7 and 8, in order to release the lock mechanism by drawing the extending part 38*b* from the slit 44*a*, the thin plate member 27 is inserted into the clearance 28 between the sidewall forming part 21*d*, which forms the side wall part 14*a*, and the outer lid part 31, and contacting it with the extending part 38*b*, to make the extending part 38*b* in a folded state, namely, a state at which the thin plate member 27 is being inserted. However, a projecting part 48*b* projects on the course from the clearance 28 to the extending part 38*b*. Thus, the thin plate member 27 cannot contact with the extending part 38*b*, and thus, the extending part 38*b* cannot be in a folded state. Therefore, it becomes difficult to release the lock of such packing box 11.

In this case, because the projecting lengths of a pair of the projecting parts 48*a* and 48*b* are longer than the extending lengths of a pair of the extending parts 38*a* and 38*b*, respectively, the contact of the other members with a pair of the extending parts 38*a* and 38*b* are more surely obstructed.

In the above detailed description of the preferred embodiment, the projecting parts 48*a* and 48*b* are formed by folding a part of the inner lid parts 41*a* and 42*b*. However, the embodiment of the invention is not limited to this constitution. For example, it is possible to form the projecting parts 48*a* and 48*b* on the course from the outside of the packing box 11 to a pair of the extending parts 38*a* and 38*b*, which are inserted into the slit 44*a*, such that they extend from the backside surface, namely, the inner side surface of the side wall forming part 21*c*.

In the above detailed description of the preferred embodiment, a pair of the projecting parts in response to each pair of the extending parts. However, the embodiment of the invention is not limited to this constitution. Alternatively, if only one extending part is provided, it is sufficient to provide only one corresponding projecting part. It is sufficient that the packing box has at least one projecting part.

In the above detailed description of the preferred embodiment, the projecting lengths of a pair of the projecting parts 48*a* and 48*b* are longer than the extending lengths of a pair of the extending parts 38*a* and 38*b*, respectively. However, the embodiment of the invention is not limited to this constitution. Alternatively, each length may be equal, or the projecting length of a pair of the projecting parts 48*a* and 48*b* may be shorter than the extending length of a pair of the extending parts 38*a* and 38*b*, respectively. In this case, when the projecting parts are provided on the side which is nearer to the clearance, it possible to obstruct the contact of the other member with the extending parts.

In the above detailed description of the preferred embodiment, a cushioning material may be provided in a certain area of the inside of the packing box.

In the above detailed description of the preferred embodiment, a corrugated fiberboard member is punched out in a shape as illustrated in FIG. 2 and folded at the folding part to form a packing box. However, the packing box is not limited to this embodiment, and may be formed by laminating a plurality of members, for example.

The embodiments described above are to be considered in all aspects as illustrative only and not restrictive in any manner. The scope of the invention is, therefore, indicated by the appended claims rather than by the foregoing description. All changes which come within the meaning and range of equivalency of the claims are to be embraced within their scope.

The packing box according to this disclosure is used particularly effectively when a locking structure which cannot be easily released is required.

What is claimed is:

1. A packing box, comprising:

a plurality of side wall parts that compose peripheral walls, a bottom wall part, a housing part to house an article, the housing part being composed of the plurality of side wall parts and the bottom wall part, an outer lid part to open and close an upper part of the housing part, the outer lid part being provided consecutively with a first side wall part of the plurality of side wall parts, a tuck that extends from an edge part opposed to a consecutive part between the first side wall part and the outer lid part, and is configured to be folded, at least one extending part that extends from a side edge of the tuck in a direction crossing a folding part between the tuck and the outer lid part, an inner flap that is provided consecutively with a second side wall part, the second side wall part being other than the first side wall part, and being opposed to the first side wall part, and is configured to be folded inward, a slit that is provided in the inner flap and is cut along the second side wall part, an obstructive part that is configured to be folded along a folding part from a side edge of the inner flap crossing the second side wall part, wherein the tuck is configured to be inserted into the slit so as to be contacted with the slit along the second side wall part while the extending part is folded, the extending part restricts, once the tuck is inserted, release of the outer lid part by restoration to the original state in a direction crossing an extending direction of the slit, an inner lid part that is provided consecutively with the second side wall part and is to be placed inside the outer lid part is provided on a side of the second side wall part of the inner flap, and the obstructive part is configured to be placed in a course from a clearance between the top edge of the first side wall part which crosses the second side wall part, and the inner flap to the extending part, and the obstructive part includes a projecting part configured to be folded along a side edge of the inner lid part such that the projecting part is opposed to the first side wall part crossing the second side wall part, and obstructs approach from the outside of the packing box to the extending part.

2. The packing box according to claim 1, wherein the tuck is provided with a pair of extensions each composed of the extending part at both ends, and a pair of projections each composed of the projecting part are provided in response to each pair of the extending parts.

3. The packing box according to claim 1, wherein a projecting length of the projecting part is configured to be longer than an extending length of the extending part.

4. The packing box according to claim 1, wherein the packing box is formed of a sheet of a plate-like member that has force of restitution in a folded state.

5. The packing box according to claim 1, further comprises a partition part that is configured to be consecutively foldable with an edge of the inner flap opposed to a consecutive part between the inner lid part and the second side wall part so that the partition part is arranged corresponding to the second side wall part, and the projecting part is formed in a substantially rectangular shape, and is arranged so as to be sandwiched between the second side wall part and the partition part.

* * * * *